United States Patent [19]

Heyraud

[11] 4,047,886

[45] Sept. 13, 1977

[54] FURNACE FOR THE CONTINUOUS SINTERING OF PELLETS OF CERAMIC NUCLEAR FUEL MATERIAL

[75] Inventor: Jacques Heyraud, Aix-en-Provence, France

[73] Assignee: Commissariat a l'Energie Atomique, Paris, France

[21] Appl. No.: 634,629

[22] Filed: Nov. 24, 1975

[51] Int. Cl.[2] ..... F27B 9/02

[52] U.S. Cl. ..... 432/128; 432/227; 432/131; 432/189; 34/216

[58] Field of Search ..... 432/121, 123, 128, 131, 432/153, 154, 187, 189, 225; 34/105, 216, 217, 236; 266/5 C

[56] References Cited

U.S. PATENT DOCUMENTS

| | | | |
|---|---|---|---|
| 3,063,878 | 11/1962 | Wilson | 432/128 |
| 3,778,221 | 12/1973 | Bloom | 432/128 |
| 3,884,624 | 5/1975 | Andrea | 432/227 |
| 3,905,758 | 9/1975 | Moussou et al. | 432/124 |

*Primary Examiner*—John J. Camby
*Assistant Examiner*—Henry C. Yuen
*Attorney, Agent, or Firm*—Cameron, Kerkam, Sutton, Stowell & Stowell

[57] ABSTRACT

The furnace comprises a hearth for the longitudinal displacement of pellet containers, means for injecting gas at both ends of the furnace, for sucking gas between preheating and sintering zones and for condensing the binder, means for displacing the containers from an introduction lock-chamber to an extraction lock-chamber, a conveyor belt which passes through a glove box and provides a leak-tight connection between the lock-chambers. A station for loading containers with pellet sub-containers prior to sintering and a station for unloading the pellet sub-containers after sintering are juxtaposed within the glove box.

3 Claims, 1 Drawing Figure

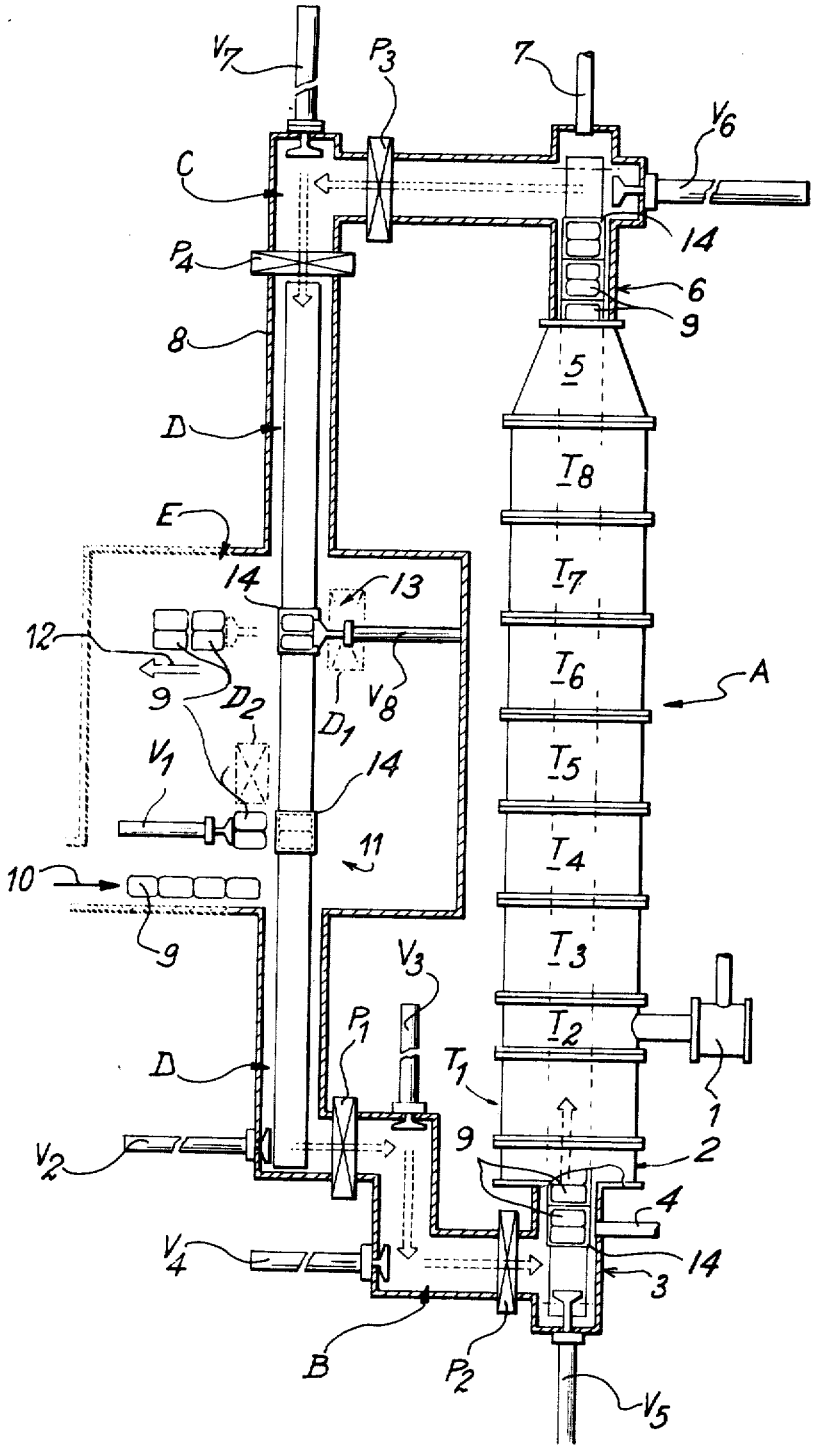
V7
P3
7
V6
C
14
P4
6
9
8
5
D
T8
E
T7
14
13
12
T6
A
9
D2
V8
D1
V1
14
T5
11
T4
10
9
T3
V3
P1
T2
D
T1
1
9
2
V2
4
V4
14
3
B
P2
V5

FURNACE FOR THE CONTINUOUS SINTERING OF PELLETS OF CERAMIC NUCLEAR FUEL MATERIAL

This invention relates to a continuous furnace for sintering ceramic nuclear fuel materials which are usually produced in the form of pellets.

The fabrication of nuclear fuels in the form of pellets involves shaping of a compact consisting of powdered fuel coated with binder followed successively by preheating which causes the removal of binder components and heating in a reducing or neutral controlled atmosphere during which the sintering operation proper takes place.

The essential aim of this invention is to provide a furnace in which the material to be sintered is circulated continuously and automatically while being maintained continuously in the controlled atmosphere which has been chosen. Moreover, the removal of the binding agents must take place in a suitable manner within a zone located close to the preheating zone in order to prevent contamination of the material during sintering by the gases which result from decomposition of the binding agents.

The invention is concerned with a furnace for the continuous sintering of pellets of ceramic nuclear fuel material in a neutral or reducing atmosphere, of the type comprising a tubular enclosure having a longitudinal axis and equipped with heating means located at intervals along said enclosure, a hearth for the longitudinal displacement of pellet containers, means for injecting gas at both ends of the furnace, means for sucking gas in an intermediate zone between the preheating and sintering zones and for condensing the binder contained therein, and means for displacing said containers along said hearth from a lock-chamber for the introduction of containers which is placed at one end of the furnace to a lock-chamber for the extraction of containers at the other end of the furnace, characterized in that the two lock-chambers are connected to each other in leak-tight manner by means of a conveyor belt which passes through a glove box, there being juxtaposed within said glove box a station for loading containers with sub-containers which contain the pellets to be sintered and a station for unloading said sub-containers which contain the sintered pellets.

By means of this arrangement, the containers move in a closed circuit and all the operations are performed automatically in a controlled atmosphere.

Further characteristic features and advantages of the invention will in any case become apparent from the description which is given hereinafter and relates to one example of a sintering furnace which is given without any implied limitation, reference being made to the accompanying drawings in which the single FIGURE is a view partly in section of a preferred embodiment of the present furnace.

The furnace which is shown in this FIGURE essentially comprises a cylindrical furnace A equipped with heating means (not shown) constituted by electric resistors located at intervals along its length. One end of the furnace is connected to a lock-chamber B for the introduction of containers loaded with pellets to be sintered and the other end is connected to a lock-chamber C for the ejection of containers loaded with sintered pellets. The two lock-chambers are connected to each other by means of a conveyor belt D which passes through a glove box E.

The furnace A is made of eight cylindrical elements $T_1$ to $T_8$. The element $T_1$ is a preheating element whilst the element $T_2$ is an element for the removal of binding agents within a condenser 1. The elements $T_3$ to $T_8$ are sintering elements.

Separate cooling coils (not shown in the FIGURE) are fixed by brazing around the condenser 1 and the furnace elements. This accordingly minimizes the danger of flooding within the furnace which might occur with a jacket-type cooling system and the attendant danger of explosion arising from the rapid vaporization which would consequently take place. The danger of reaching the critical state due to a possible contact between water and fissile material is also minimized.

The furnace also comprises a cylindrical element 2 fitted with a connecting chamber 3 associated with the introduction chamber B.

A pipe 4 for the injection of gas and a jack $V_5$ open into the connecting chamber 3. The successive movements of thrust of said jack produce a step-by-step displacement of the continuous train of containers along the hearth of the furnace.

The jack $V_5$ is actuated either by a low-speed forward-motion motor or by a high-speed return motor, the movement of backward return being initiated by an end-of-travel contact.

The lock-chamber B is equipped with two doors $P_1$ and $P_2$ and with two jacks $V_3$ and $V_4$. On the element $T_8$ is fixed a frusto-conical element 5 extended by a connecting chamber 6 into which open a pipe 7 for the admission of gas and a jack $V_6$. The connecting chamber 6 is associated with the lock-chamber C by means of a door $P_3$. The lock-chamber C additionally comprises a jack $V_7$ and a door $P_4$ for establishing a communication with a passage 8 in which the conveyor belt D is capable of displacement.

The lock-chambers B and C are each fitted with two pipes (not shown) for the injection and discharge of a gas in order to ensure that each lock-chamber can contain at any moment an atmosphere corresponding to that of the upstream or downstream enclosure with which it is intended to be put into communication.

The pellets to be sintered which are formed for example of mixed uranium and plutonium oxide are poured into small metallic vessels or sub-containers 9 of molybdenum, for example, which contain approximately 1.5 Kg of fuel pellets.

The sub-containers which have thus been filled are introduced into the glove box E (arrow 10). Two sub-containers are then brought to the loading station 11 by transfer mans (which have not been illustrated in order to avoid complication of the drawing). At the loading station, a jack $V_1$ serves to transfer said sub-containers into a container 14 which has been brought to an oppositely-facing location by the conveyor belt D.

The loading station 13 is placed within the groove box E next to the loading station 11 and comprises a jack $V_8$ for the ejection of sub-containers which contain the sintered pellets; these latter are placed in a storage position prior to discharge from the glove box (arrow 12). Detectors $D_1$ and $D_2$ ensure coordination of the displacement of the conveyor belt and of the jacks $V_8$ and $V_1$ as will be explained hereinafter.

The operation of the furnace can be deduced from the foregoing and will therefore be described below only in brief outline.

Two sub-containers 9 are thrust forward by the jack $V_1$ at the loading station 11 into a sintering container 14. During this stage, the conveyor belt D is stationary and the container is placed in a preset position for the purpose of loading.

The conveyor belt is started-up again and stopped automatically by means of an end-of-travel contact when the container has reached the entrance of the lock-chamber B. The doors $P_1$ and $P_2$ of the lock-chamber B are closed while this latter is being swept by a gas which is identical with the gas contained in the enclosure E and which can consist of nitrogen, for example. When filling with nitrogen has been completed, the door $P_1$ is opened, the jacks $V_2$ and $V_3$ push the container into the interior of the lock-chamber B. The door $P_1$ is again closed. The nitrogen contained in the lock-chamber B is removed and this latter is then filled with the gas employed for the sintering operation, for example hydrogen. The door $P_2$ is opened. The jack $V_4$ pushes the container into the connecting chamber 3, the jack $V_5$ being then located in its rear position. The door $P_2$ is closed again. The jack $V_5$ pushes the container towards the furnace.

When the container arrives within the connecting chamber 6 at the level of the jack $V_6$, an end-of-travel contact (not shown) stops the thrust of the jack $V_5$ which is returned to the rear position. The jack $V_6$ directs the container towards the lock-chamber C, the door $P_3$ being then opened and the lock-chamber C filled with hydrogen.

After closure of the door $P_3$, the lock-chamber C is swept with nitrogen. On completion of the sweeping operation, the door $P_4$ is opened. The jack $V_7$ pushes the container onto the conveyor belt D which is set in motion. The door $P_4$ is again closed, the lock-chamber C is swept with hydrogen and the door $P_3$ is again opened. At the same time, the container is transported to the unloading station 13, the detector $D_1$ initiates the stopping of the conveyor belt and the forward displacement of the jack 8 which ejects the sub-containers 9. The jack 8 then returns to the rest position and the conveyor belt is again set in motion. If the detector $D_2$ detects the presence of sub-containers 9, said detector stops the conveyor belt at the loading station 11. The jack $V_1$ then guides the sub-containers 9 into the containers 14 and then returns to its inactive position while the conveyor belt transfers the container 14 to the furnace. The container is stopped at the loading station only if the presence of sub-containers has been detected.

The detection systems constituted by the detectors are of particular interest at the moment of starting and at the moment of stopping of a sintering cycle.

It is important to note that, by virtue of the means described in the foregoing, the pellet containers travel in a closed circuit and are continuously maintained in the controlled atmosphere which has been chosen. Displacement of the containers takes place automatically; these latter form within the furnace A a continuous train which is transferred in step-by-step motion under the thrust of the jack $V_5$ whilst the conveyor belt D contains at any given moment a maximum of one container during transfer between the lock-chambers C and B.

It is readily apparent that the invention is not limited to the embodiments which have been more especially described with reference to the FIGURE but is intended on the contrary to cover all alternative forms.

What we claim is:

1. A furnace for the continuous sintering of pellets of ceramic nuclear fuel material in a neutral or reducing atmosphere, comprising a tubular enclosure having a longitudinal axis and equipped with heating means located at intervals along said enclosure, a hearth for the longitudinal displacement of pellet containers, means for injecting gas at both ends of the furnace, means for sucking gas in an intermediate zone between the preheating and sintering zones and for condensing a binder for the pellets, and means for displacing said containers along said hearth from a lock-chamber for the introduction of containers which is placed at one end of the furnace to a lock-chamber for the extraction of containers at the other end of the furnace, wherein the two lock-chambers are connected to each other in leak-tight manner by means of a conveyor belt which passes through a glove box, there being juxtaposed within said glove box a station for loading containers with sub-containers which contain the pellets to be sintered and a station for unloading said sub-containers which contain the sintered pellets.

2. A sintering furnace according to claim 1, wherein a system for detecting the presence or absence of sub-containers in a container is associated with the unloading station and means for detecting the presence or absence of sub-containers located opposite to the loading station is associated with said loading station.

3. A sintering furnace according to claim 1, wherein the furnace and the binder condenser comprise external cooling means constituted by separate coil-tubes which are brazed onto the frame of the furnace elements or onto the frame of the binder condenser.

* * * * *